US006510921B2

(12) United States Patent
Price

(10) Patent No.: US 6,510,921 B2
(45) Date of Patent: Jan. 28, 2003

(54) MUFFLER/EXHAUST EXTRACTOR

(75) Inventor: Kenneth E. Price, Yorba Linda, CA (US)

(73) Assignee: Samson Motorcycle Products, Inc., Anaheim, CA (US)

( * ) Notice: Subject to any disclaimer, the term of this patent is extended or adjusted under 35 U.S.C. 154(b) by 0 days.

(21) Appl. No.: 09/788,848

(22) Filed: Feb. 19, 2001

(65) Prior Publication Data

US 2002/0112915 A1 Aug. 22, 2002

(51) Int. Cl.[7] ..... F01N 1/08

(52) U.S. Cl. ..... 181/264; 181/265; 181/266; 181/267; 181/269; 181/270; 181/279; 181/280

(58) Field of Search ..... 181/264–267, 181/269, 270, 277–280

(56) References Cited

U.S. PATENT DOCUMENTS

| | | | | |
|---|---|---|---|---|
| 992,839 A | * | 5/1911 | Wolle et al. | 181/264 |
| 1,638,309 A | | 8/1927 | Kemble | |
| 2,065,343 A | | 12/1936 | Moore et al. | |
| 4,184,565 A | | 1/1980 | Price et al. | |
| 4,360,075 A | | 11/1982 | Blaser et al. | |
| 5,183,976 A | | 2/1993 | Plemons, Jr. | |
| 5,282,361 A | | 2/1994 | Sung | |
| 5,633,482 A | * | 5/1997 | Erion et al. | 181/282 |
| 5,892,186 A | | 4/1999 | Flugger | |
| 5,902,970 A | | 5/1999 | Ferri | |
| 6,116,377 A | | 9/2000 | Dugan | |

* cited by examiner

*Primary Examiner*—Shih-Yung Hsieh

(57) ABSTRACT

A muffler has an elongated generally cylindrical casing having inlet and outlet ends, an elongated generally frustroconical baffle in the casing adjacent the inlet end with the smaller diameter portion being spaced from the inlet end. The peripheral wall of the baffle has closely spaced perforations over the major portion of its axial length and is spaced from the shell to provide a chamber thereabout. A generally cylindrical baffle has one end extending over the smaller diameter portion of the frustroconical baffle and has its peripheral wall spaced from the casing to provide a chamber thereabout. The peripheral wall of the cylindrical baffle has closely spaced perforations over most of its length. Exhaust gases enter the frustroconical baffle and exit through the perforations therein, move axially in the casing thereabout, and then pass through the apertures into the cylindrical baffle.

16 Claims, 4 Drawing Sheets

MUFFLER/EXHAUST EXTRACTOR

BACKGROUND OF THE INVENTION

This invention is related to exhaust systems, and, more particularly, to a muffler which will facilitate exhaust action and noise abatement of high velocity exhaust gas flow. Internal combustion engines and turbines produce exhaust combustion gases and the discharged exhaust is frequently accompanied by undesirable levels of noise. The problem of muffling and evacuating such exhaust gases is well known.

Automobiles utilize exhaust systems coupled with an internal combustion engine which are comprised of combinations of headers, collectors, converters and mufflers. One type of muffler contains a plurality of baffles to provide a plurality of chambers within a casing or housing. The baffles are arranged to form a circuitous path from the inlet end of the housing to its exit end. Typically, sound absorbing material such as stainless steel wool is also provided in portions of the housing to further reduce the high frequency components of noise.

Another type of exhaust system component which facilitates the evacuation of exhaust gases is described in Sung U.S. Pat. No. 5,282,361. Induction and acceleration of air is obtained from forward movement of a vehicle by a guided flow depression device and a forced exhaust device to improve engine operating efficiency by reducing back pressure at engine exhaust ports. However, little or no sound muffling is provided by the device.

It is an object of the present invention to provide a novel muffler which also facilitates extraction of the exhaust from the engine.

Another object is to provide such a muffler with components which can be readily fabricated and assembled to provide a relatively long lived device.

It is also a specific object to provide such a muffler which is relatively low cost, is relatively lightweight, has operating characteristics that can be readily tuned to a particular engine and exhaust system, and is resistant to rust and corrosion.

SUMMARY OF THE INVENTION

It has now been found that the foregoing and related objects may be readily attained in a muffler and exhaust extractor comprising an elongated, generally cylindrical casing having inlet and outlet ends in which there is disposed adjacent the inlet end, an elongated generally frustroconical baffle with the smaller diameter portion being spaced from the inlet end. The peripheral wall of the baffle has perforations therein which are closely spaced about the periphery and extend over the major portion of the axial length thereof. The baffle is spaced from the shell over the major portion of its axial length to provide a chamber thereabout.

Also disposed within the chamber is a generally cylindrical baffle having one end extending over the smaller diameter portion of the frustroconical baffle. The peripheral wall of the cylindrical baffle is spaced from the casing over substantially the entire length thereof to provide a chamber thereabout. The peripheral wall has closely spaced perforations extending circumferentially thereabout and over the major portion of its length.

In operation, a substantial portion of the volume of exhaust gases entering the inlet end of the frustroconical baffle exits through the perforations in its peripheral wall and thence move generally axially in the chamber thereabout and into the chamber about the cylindrical baffle. The exhaust gases then pass into the cylindrical baffle through its apertures and move axially therethrough to the exit end of the casing.

The end of the smaller diameter portion of the frustroconical baffle is open so that some of the exhaust gases are accelerated and pass axially therethrough directly into the interior of the cylindrical baffle.

Desirably, the apertures in the peripheral wall of the cylindrical baffle are oriented in a spiral pattern and are provided by punching and deforming the wall to provide louvers or internally extending scoop-shaped formations opening towards the exit end.

Desirably, the inlet end of the frustroconical baffle is supported by a first end cap with an outwardly extending generally cylindrical flange for connection to an element of the exhaust system. The inlet end of the casing is secured to the outer surface of the first end cap. The inlet end of the cylindrical baffle is supported by the outlet end of the frustroconical baffle and the outlet end of the cylindrical baffle is supported by a removable second or outlet end cap in the casing adjacent the outlet end thereof.

In another embodiment, the smaller diameter end portion of the frustroconical baffle is closed and all exhaust gases must exit through the apertures in the peripheral wall of the frustroconical baffle and pass into the cylindrical baffle through the apertures in its peripheral wall.

If so desired, sound dampening, heat resistant fibrous material such as fiberglass can be inserted into the chamber about the baffles.

DETAILED DESCRIPTION OF THE ILLUSTRATED EMBODIMENT

Figure 1:
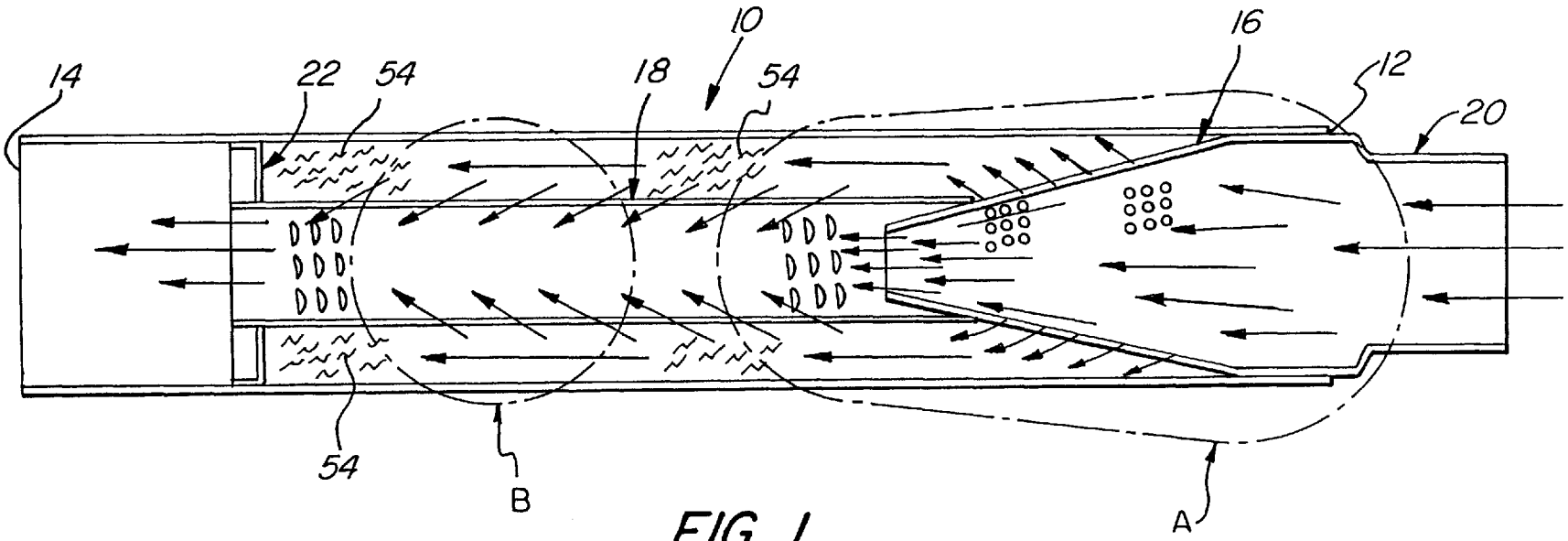
FIG. 1 is a semi-diagrammatic longitudinal sectional view of an engine muffler/exhaust extractor embodying the present invention.

Turning first to FIG. 1 therein illustrated is an engine muffler/exhaust extractor embodying the present invention which is generally comprised of a tubular or cylindrical casing generally designated by the numeral 10 having an inlet end 12 and 14. Seated within the casing 10 adjacent its inlet end 12 is a frustroconical baffle generally designated by the numeral 16. Also seated within the casing 10 is a cylindrical baffle generally designated by the numeral 18 which extends over the small diameter end portion 38 of the frustroconical baffle 16 and is supported adjacent the discharge end by the end cap generally designated by the numeral 22. At the inlet end of the casing 10 is an end cap generally designated by the numeral 20. FIG. 1 also illustrates that the baffles 16 and 18 are dimensioned so that there is an annular space thereabout providing a chamber 24 external to both baffles. Lastly FIG. 1 includes numerous arrows to diagrammatically illustrate the flow of the exhaust gases therethrough.

Figure 2:
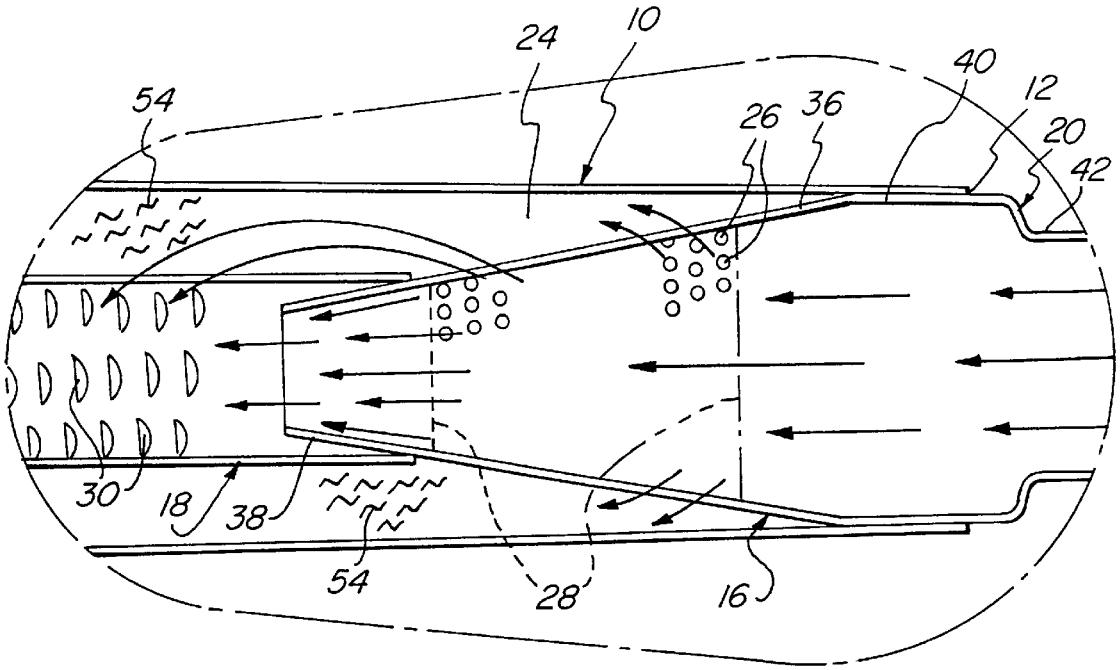
FIG. 2 is an enlarged view of the section marked "A" in FIG. 1.
Figure 5:
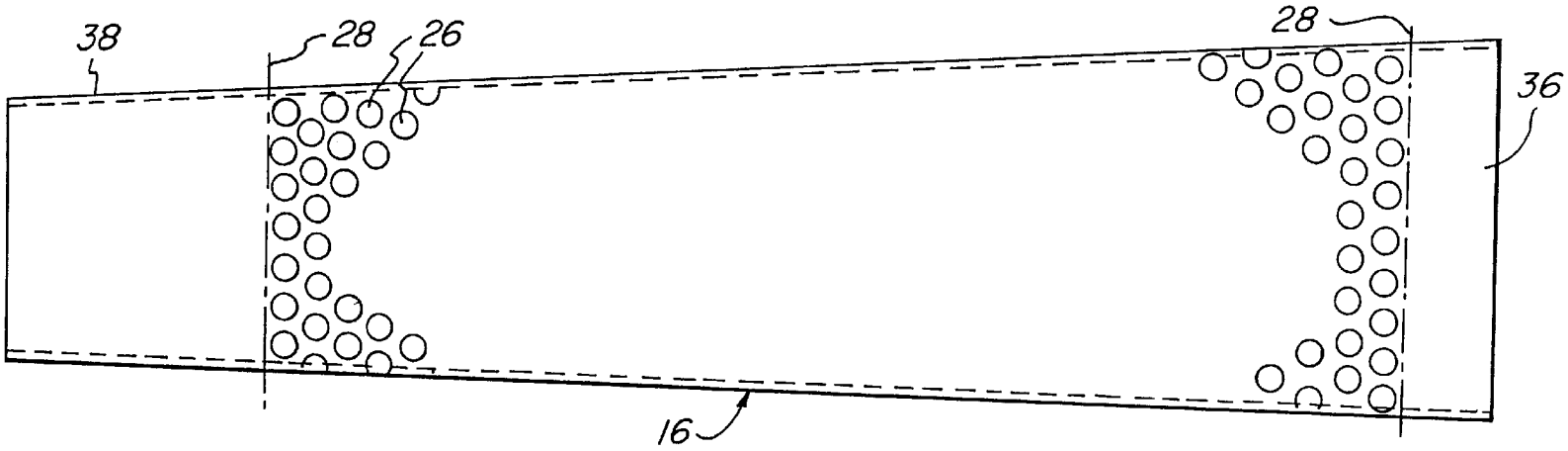
FIG. 5 is an enlarged elevational view of the frustroconical baffle.
Figure 6:
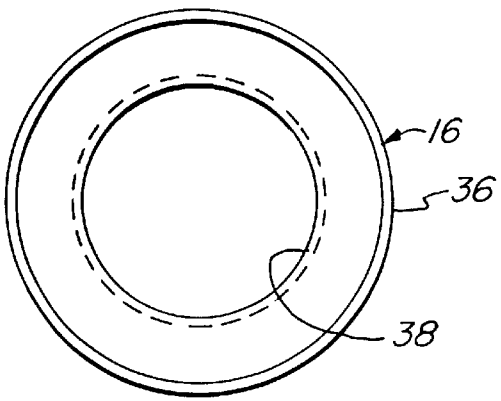
FIG. 6 is an elevational view of the small diameter end of the frustroconical baffle.

Turning now in detail to the frustroconical baffle 16 which is best illustrated in FIGS. 2 and 5–6, the central section thereof is provided with closely spaced apertures 26 extending about the periphery thereof providing communication from its interior with the chamber 24. Although the apertures 26 are only shown adjacent the ends of the perforated section, it will be appreciated that they extend over the full length of the baffle 16 between the imaginary lines 28. The small diameter end portion 38 and the large diameter end portion 36 are both imperforate although the perforations 26 could be extended to both ends of the baffle 16 to facilitate use of fully perforated sheet material.

Figure 3:
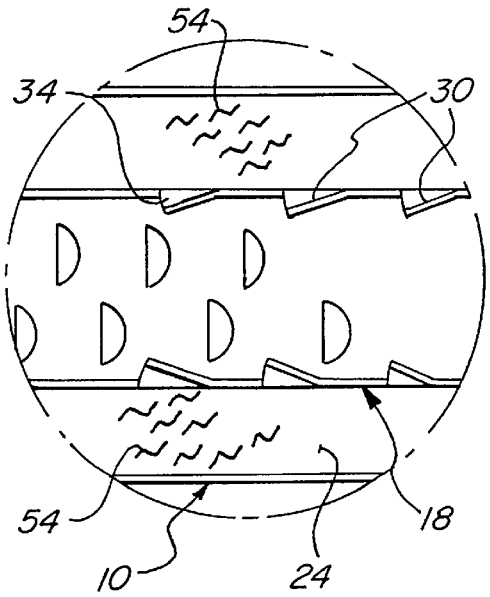
FIG. 3 is an enlarged view of the section marked "B" in FIG. 1.
Figure 7:
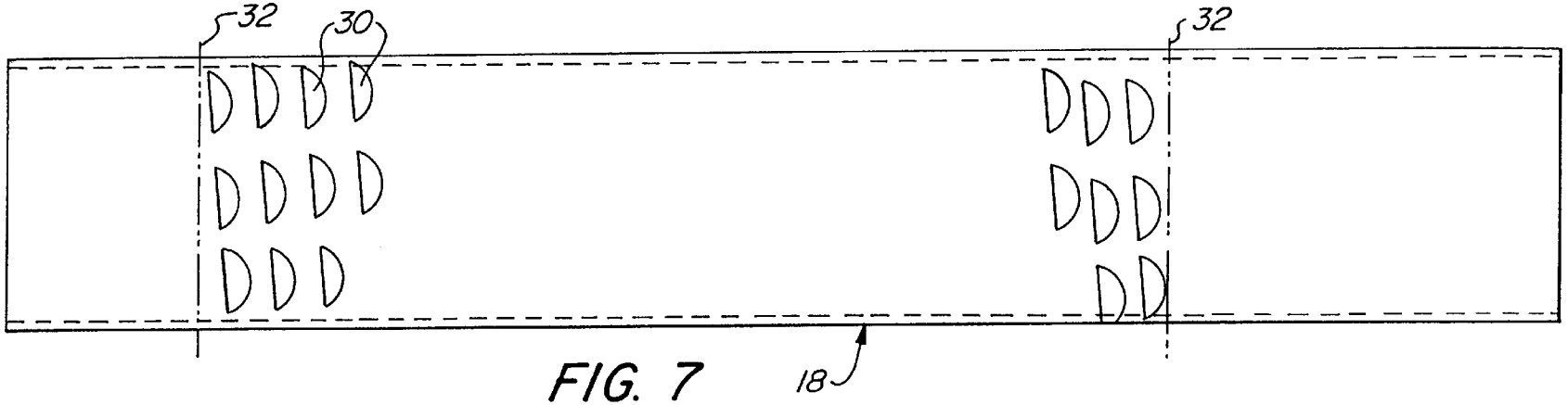
FIG. 7 is an enlarged side elevational view of the cylindrical baffle.
Figure 9:
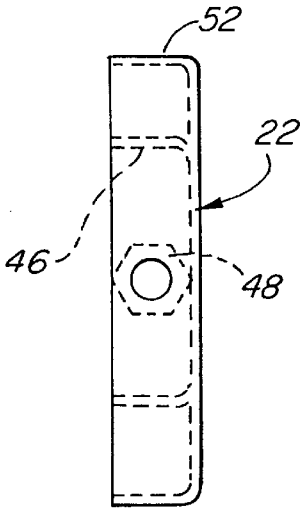
FIG. 9 is a side elevational view thereof.
Figure 8:
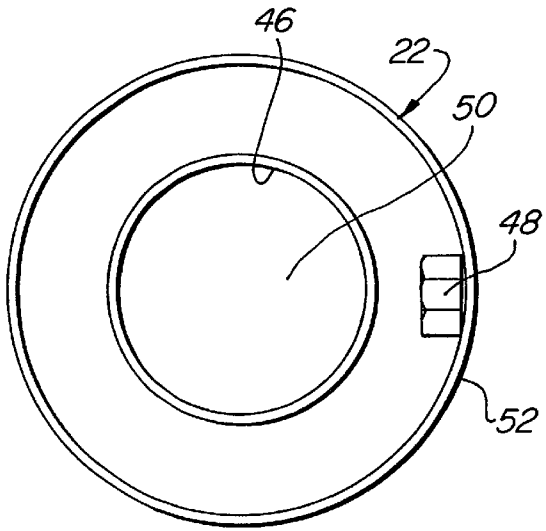
FIG. 8 is an elevational view of the outlet end cap.

Turning next to the cylindrical baffle 18 which is best seen in FIGS. 3 and 7, the two end portions are imperforate, but the entire center section is provided with helically oriented closely spaced apertures 30, i.e., over its entire length between the imaginary lines 32. As best seen in FIG. 3, the perforations 30 in the cylindrical baffle 18 are not only oriented in a helical pattern, but also have the metal deformed thereabout to provide louver-like or scoop-shaped formations which have an open end 34 disposed towards the outlet end 14 of the casing 10 for a purpose to be described more fully hereinafter.

Figure 4:
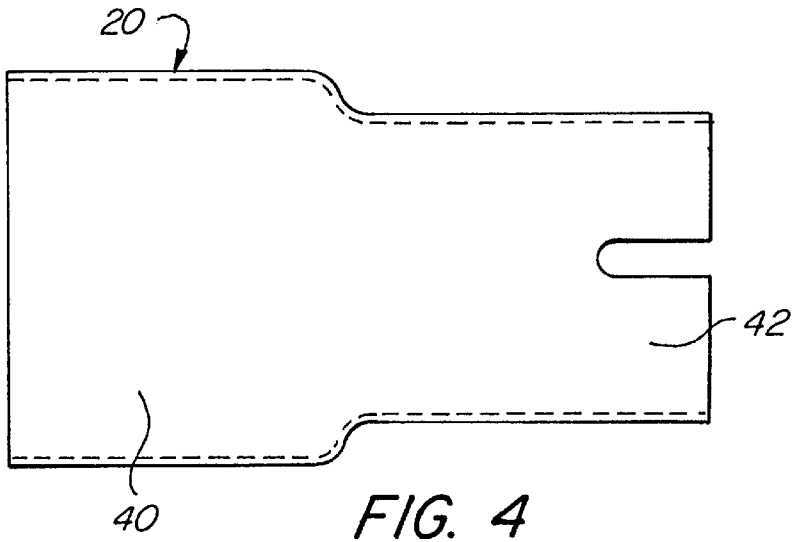
FIG. 4 is a side elevational view of the inlet end cap.

Turning now to FIG. 4 therein illustrated in elevation is the inlet end cap 20 which has a circular cross section throughout its length. The larger diameter inner end portion 40 fits snugly within the casing 10, and the smaller diameter end portion 42 extends outwardly of the casing 10 for coupling to an adjacent component of the exhaust system (not shown).

As best seen in FIG. 2, the larger diameter end portion 40 of the end cap 20 abuts the larger diameter end portion 30 of the frustroconical baffle 16, and the two components may be welded to the casing 10 to secure the three elements in firm assembly. Alternatively, the end cap 20 and the baffle 16 can be butt welded, inserted into the casing 10, and tack welded to the casing 10.

The cylindrical baffle 18 seats snugly into the central opening 50 of the annular outlet end cap 22 bounded by the inner flange 46 and can be welded thereto to provide a rigid assembly which can be removed from the casing 10 by disengaging the fastener 48 which is seated in the outer flange 52 from the wall of the casing 10. This is especially desirable if fibrous sound baffling materials 54 is packed about the cylindrical baffle 18 in the chamber 24.

Baffling material 54 is schematically illustrated only in parts of the chamber 24, but will normally fill the entire chamber about the cylindrical baffle 18 when employed.

In the preferred structure, the casing increases in diameter from its inlet end to its outlet end to facilitate flow of exhaust gases therethrough. An increase of one inch over a length of twenty-four inches has been found quite satisfactory.

As will be readily appreciated, the baffle components can be readily fabricated by first pre-punching sheet metal such as stainless steel and then forming the sheet material into the frustroconical and cylindrical baffles. The abutted ends of the sheet material can then be welded. The discharge end caps can be stamped from sheet metal, and the casing and inlet end cap can both be formed from tubing.

Although various metals and ceramics may be employed for the components, stainless steel is preferred for its resistance to corrosion. For the fibrous sound absorbing materials, fiberglass is preferred because of its low cost which allows the owner to replace it from time to time to maintain high efficiency of flow through the muffler.

In performance tests, the muffler of the present invention has been found to provide enhanced engine performance because it not only reduces back pressure, but also appears to facilitate withdrawal of the exhaust from the engine.

As diagrammatically shown in FIGS. 1–3, the exhaust enters the frustroconical baffle and is partially vented through the apertures in its peripheral wall into the chamber thereabout. A substantial portion of the exhaust gas continues on a direct path through the reducing cross section of the baffle and is accelerated as it passes from the nozzle-like end into the cylindrical baffle. As the high velocity exhaust gas stream proceeds through the cylindrical baffle, the exhaust gas which has entered the chamber passes through the louvers and into the cylindrical baffle. The combination of the forward orientation of the openings in the scoop shaped louvers provides rapid flow of the exhaust gases therethrough and they are swept along with the exhaust gas which has passed directly into the cylindrical baffle.

Tests on mufflers embodying the present invention indicate that the high speed flow into the cylindrical baffle through the nozzle provided by the reduced diameter end of the frustroconical baffle may provide a partial vacuum about the louvers and facilitate exhaust flow through the chamber and any fibrous packing therein.

The orientation of the louvers in the cylindrical baffle along a helical path reduces noise by precluding straight line flow of the gas from the chamber into the cylindrical baffle. Although the fibrous packing in the chamber does serve to reduce noise, substantial noise reduction is obtained by the muffler of the present invention without such packing.

Thus, it can be seen from the foregoing detailed specification and attached drawings that the novel muffler of the present invention provides desirable sound reduction and exhaust extraction. It may be assembled from components which are readily fabricated and relatively economical, and it will exhibit relatively long life use of corrosion resistant metals.

Having thus described the invention, what is claimed is:

1. A muffler and exhaust extractor comprising:

(a) an elongated generally cylindrical casing having inlet and outlet ends;

(b) a generally frustroconical baffle in said casing adjacent said inlet end, said frustroconical baffle being elongated with the smaller diameter outlet end portion being spaced from said inlet end, the peripheral wall of said baffle having perforations therein closely spaced about the periphery and over the major portion of the axial length thereof, said baffle being spaced from said shell over the major portion of its axial length to provide a chamber thereabout; and (c) a generally cylindrical baffle having a diameter greater than the diameter of the smaller diameter outlet end portion of said frustroconical baffle, said cylindrical baffle having an inlet end portion seating therein the smaller diameter outlet end portion of said frustroconical baffle, and having said inlet end portion extending over the smaller diameter outlet end portion of said frustroconical baffle, to provide an open space between the outlet end portion of said frustroconical baffle and the inlet end portion of said cylindrical baffle, and said cylindrical baffle having its peripheral wall spaced from said casing over substantially the entire length thereof to provide a chamber thereabout said peripheral wall having closely spaced perforations extending circumferentially thereabout and over the major portion of its length, the outlet end of said frustroconical baffle being open so that some of the exhaust gases pass axially therethrough into the interior of said cylindrical baffle which is of larger diameter than said outlet end of said frustroconical baffle, whereby a substantial portion of: the volume of exhaust gases entering the inlet end of said frustroconical baffle exits through said perforations in said peripheral wall and thence moves generally axially in said chamber thereabout and into said chamber about said cylindrical baffle, the exhaust gases then passing into said cylindrical baffle through said apertures therein and moving axially therethrough to said outlet end of said casing, and some of the entering exhaust gases passing axially through said open outlet end of said frustroconical baffle directly into the interior of said cylindrical baffle and then axially therethrough to said outlet end.

2. The muffler and exhaust extractor in accordance with claim 1 wherein the apertures in the peripheral wall of said cylindrical baffle are oriented in a spiral pattern.

3. The muffler and exhaust extractor in accordance with claim 1 wherein the inlet end of said frustroconical baffle is supported by a first end cap with an outwardly extending generally cylindrical flange for connection to an element of the exhaust system.

4. The muffler and exhaust extractor in accordance with claim 3 wherein the inlet end of said casing is secured to the outer surface of said end cap.

5. The muffler and exhaust extractor in accordance with claim 1 wherein said outlet end of said cylindrical baffle is supported by a second end cap in said casing adjacent said outlet end thereof.

6. The muffler and exhaust extractor in accordance with claim 5 wherein said second end cap is removably secured in said casing by a fastener.

7. The muffler and exhaust extractor in accordance with claim 6 wherein said cylindrical baffle is removably seated on said frustroconical baffle.

8. The muffler and exhaust extractor in accordance with claim 1 wherein there is included heat-resistant fibrous material in said chamber to enhance sound reduction.

9. The muffler and exhaust extractor in accordance with claim 8 wherein said heat-resistant fibrous material is fiberglass.

10. A muffler and exhaust extractor comprising:

an elongated generally cylindrical casing having inlet and outlet ends;

(b) a generally frustroconical baffle in said casing adjacent said inlet end, said frustroconical baffle being elongated with the smaller diameter portion of said frustroconical baffle being spaced from said inlet end and being open at its outlet end, the peripheral wall of said baffle having perforations therein closely spaced about the periphery thereof and over the major portion of the axial length thereof, said peripheral wall being spaced from said shell over the major portion of its axial length to provide a chamber thereabout; and (c) a generally cylindrical baffle in said casing having a diameter greater than the diameter of the smaller diameter outlet end portion of said frustroconical baffle, said cylindrical baffle having an inlet end portion seating therein the small diameter outlet end portion of said frustroconical baffle to provide an open space between the outlet end portion of said frustroconical baffle and the inlet end portion of said cylindrical baffle, said inlet end portion extending over the smaller diameter outlet end portion of said frustroconical baffle, said cylindrical baffle having its peripheral wall spaced from said casing over substantially its entire length to provide a chamber thereabout, said peripheral wall having closely spaced perforations extending about the periphery and over the major portion of its length, said apertures in said cylindrical baffle being oriented in a spiral pattern about the periphery of said baffle, whereby a substantial portion of the volume of exhaust gases entering the inlet end of said frustroconical baffle exits through said perforations in said peripheral wall and thence moves generally axially in said chamber thereabout and into said chamber about said cylindrical baffle, the exhaust gases then passing through the apertures in said cylindrical baffle and moving axially therethrough to said outlet end of said casing, and some of the entering exhaust gases passing axially through said open outlet end of said frustroconical baffle directly into the interior of said cylindrical baffle and then axially therethrough to said outlet end.

11. A muffler and exhaust extractor comprising:

(a) an elongated generally cylindrical casing having inlet and outlet ends;

(b) a generally frustroconical baffle in said casing adjacent said inlet end, said frustroconical baffle being elongated with the smaller diameter portion of said frustroconical baffle being spaced from said inlet end and being open at its outlet end, the peripheral wall of said baffle having perforations therein closely spaced about the periphery thereof and over the major portion of the axial length thereof, said peripheral wall being spaced from said shell over the major portion of its axial length to provide a chamber thereabout; and (c) a generally cylindrical baffle in said casing having a diameter greater than the diameter of the smaller diameter outlet end portion of said frustroconical baffle, said cylindrical baffle seating therein the small diameter outlet end portion of said frustroconical baffle and having one end extending over the smaller diameter portion of said frustroconical baffle, said cylindrical baffle having its peripheral wall spaced from said casing over substantially its entire length to provide a chamber thereabout, said peripheral wall having closely spaced perforations extending about the periphery and over the major portion of its length, said apertures in said cylindrical baffle being oriented in a spiral pattern about the periphery of said baffle, whereby a substantial portion of the volume of exhaust gases entering the inlet end of said frustroconical baffle exits through said perforations in said peripheral wall and thence moves generally axially in said chamber thereabout and into said chamber about said cylindrical baffle, the exhaust gases then passing through the apertures in said cylindrical baffle and moving axially therethrough to said outlet end of said casing, and some of the entering exhaust gases passing axially through said open outlet end of said frustroconical baffle directly into the interior of said cylindrical baffle and then axially therethough to said outlet end.

12. The muffler and exhaust extractor in accordance with claim 11 wherein the inlet end of said frustroconical baffle is supported by a first end cap with an outwardly extending generally cylindrical flange for connection to an element of the exhaust system and wherein said outlet end of said cylindrical baffle is supported by a second end cap in said casing adjacent said outlet end thereof.

13. The muffler and exhaust extractor in accordance with claim 11 wherein said second end cap is removably secured in said casing by a fastener.

14. The muffler and exhaust extractor in accordance with claim 11 wherein there is included heat-resistant fibrous material in said chamber to enhance sound reduction.

15. The muffler and exhaust extractor in accordance with claim 11 wherein said apertures in said cylindrical baffle are provided by internally scoop-shaped formations which are open towards the discharge end of said casing.

16. The muffler and exhaust extractor in accordance with claim 11 wherein the inlet end of said casing is secured to the outer surface of said first end cap.

* * * * *